US010471974B2

(12) United States Patent
Hirashima et al.

(10) Patent No.: US 10,471,974 B2
(45) Date of Patent: Nov. 12, 2019

(54) RAILCAR

(71) Applicant: KAWASAKI JUKOGYO KABUSHIKI KAISHA, Hyogo (JP)

(72) Inventors: Toshiyuki Hirashima, Kobe (JP); Naotake Honda, Kobe (JP); Hiroshi Enomoto, Kobe (JP)

(73) Assignee: KAWASAKI JUKOGYO KABUSHIKI KAISHA, Hyogo (JP)

( * ) Notice: Subject to any disclaimer, the term of this patent is extended or adjusted under 35 U.S.C. 154(b) by 230 days.

(21) Appl. No.: 15/559,572

(22) PCT Filed: Mar. 20, 2015

(86) PCT No.: PCT/JP2015/001569

§ 371 (c)(1),
(2) Date: Sep. 19, 2017

(87) PCT Pub. No.: WO2016/151613

PCT Pub. Date: Sep. 29, 2016

(65) Prior Publication Data

US 2018/0043907 A1 Feb. 15, 2018

(51) Int. Cl.

| | |
|---|---|
| ***B61D 17/10*** | (2006.01) |
| ***B61F 1/02*** | (2006.01) |
| *B61D 1/04* | (2006.01) |

(52) U.S. Cl.

CPC ..... *B61D 17/10* (2013.01); *B61F 1/02* (2013.01); *B61D 1/04* (2013.01)

(58) Field of Classification Search

CPC .. B61D 17/10; B61D 1/04; B64C 1/18; B64D 11/0696; B60N 2/01575

(Continued)

(56) References Cited

U.S. PATENT DOCUMENTS 3,626,464 A * 12/1971 Van Der Sluys ..... B61D 17/10 105/418
5,309,845 A * 5/1994 Onishi ..... B61D 17/04 105/418

(Continued)

FOREIGN PATENT DOCUMENTS

EP 0063214 A1 10/1982
JP S59-153654 A 9/1984

(Continued)

OTHER PUBLICATIONS

International Search Report issued in PCT/JP2015/001569; dated Jun. 2, 2015.

(Continued)

*Primary Examiner* — Zachary L Kuhfuss
(74) *Attorney, Agent, or Firm* — Studebaker & Brackett PC

(57) ABSTRACT

A railcar includes a floor structure including: an underframe including a pair of side sills and a plurality of cross beams arranged between the pair of side sills; a plurality of floor panel receivers located above the cross beams, arranged with gaps in a car width direction, extending along the cross beams, and fixed to the cross beams; one or more seat receivers extending through the gaps in a car longitudinal direction and fixed to the cross beams; and floor panels covering substantially entire surfaces of upper portions of the floor panel receivers and an upper portion(s) of the one or more seat receivers from above and supported by the cross beams through the floor panel receivers and the one or more seat receivers.

9 Claims, 8 Drawing Sheets

(58) Field of Classification Search
USPC ..... 105/422
See application file for complete search history.

(56) References Cited

U.S. PATENT DOCUMENTS

| | | | | |
|---|---|---|---|---|
| 5,339,745 | A * | 8/1994 | Ritzl | B60G 99/00 105/422 |
| 6,554,225 | B1 * | 4/2003 | Anast | B64C 1/18 105/422 |
| 8,544,796 | B2 * | 10/2013 | Pozzi | B64C 1/18 244/118.6 |
| 8,998,137 | B2 * | 4/2015 | Braeutigam | B64C 1/18 244/118.5 |
| 9,108,648 | B2 * | 8/2015 | Li | B61F 1/00 |
| 9,108,649 | B2 * | 8/2015 | Taguchi | B61D 17/10 |
| 9,180,894 | B2 * | 11/2015 | Taguchi | B61D 17/10 |
| 9,233,694 | B2 * | 1/2016 | Kato | B61D 17/00 |
| 9,376,125 | B2 * | 6/2016 | Bigras | B61D 17/10 |
| 9,533,692 | B2 * | 1/2017 | Hirashima | B61D 17/10 |
| 9,586,671 | B2 * | 3/2017 | Deloubes | B64C 1/18 |
| 9,592,839 | B2 * | 3/2017 | Hirashima | B61D 17/10 |
| 10,005,537 | B2 * | 6/2018 | Guering | B64C 1/18 |
| 10,029,709 | B2 * | 7/2018 | Tateishi | B61D 17/10 |
| 2011/0233339 | A1 * | 9/2011 | Plant | B64C 1/18 244/131 |
| 2014/0083321 | A1 * | 3/2014 | Kato | B61D 17/10 105/413 |
| 2015/0203131 | A1 * | 7/2015 | Langert | B61D 17/10 105/422 |
| 2015/0367863 | A1 * | 12/2015 | Hirashima | B61D 17/10 105/422 |
| 2018/0037238 | A1 * | 2/2018 | Hirashima | B61D 17/10 |
| 2018/0043907 | A1 * | 2/2018 | Hirashima | B61D 17/10 |

FOREIGN PATENT DOCUMENTS

| | | | |
|---|---|---|---|
| JP | S63-006970 | U | 1/1988 |
| JP | S64-023885 | U | 2/1989 |
| JP | H5-000664 | A | 1/1993 |
| JP | 2002-362358 | A | 12/2002 |
| JP | 2007-191016 | A | 8/2007 |
| JP | 2013-212762 | A | 10/2013 |
| WO | 2013/150736 | A1 | 10/2013 |

OTHER PUBLICATIONS

An Office Action mailed by the State Intellectual Property Office of the People's Republic of China dated Jul. 4, 2018, which corresponds to Chinese Patent Application No. 201580077958.3 and is related to U.S. Appl. No. 15/559,572.

* cited by examiner

RAILCAR

TECHNICAL FIELD

The present invention relates to a railcar and particularly to a railcar including a floor structure having an improved heat insulating property.

BACKGROUND ART

A railcar bodyshell includes: an underframe; a pair of side bodyshells provided at both respective car width direction sides of the underframe; and a roof bodyshell provided over the side bodyshells. The underframe includes: a pair of side sills extending in a car longitudinal direction; and a plurality of cross beams each extending in a car width direction and connected to the pair of side sills. Floor panels are arranged above the underframe, and seats are arranged above the floor panels.

For example, as disclosed in PTL 1, a supporting structure for the seats is configured such that: a seat receiver continuously extending in a car longitudinal direction is arranged above the plurality of cross beams; the seat receiver is exposed to an interior of a car through a gap between the floor panels supported by the cross beams; and the seats are supported by this exposed portion of the seat receiver.

CITATION LIST

Patent Literature

PTL 1: Japanese Laid-Open Patent Application Publication No. 5-664

SUMMARY OF INVENTION

Technical Problem

According to the seat supporting structure of PTL 1, the seat receiver and the underframe, both of which are high in heat conductivity, are directly coupled to each other, and the seat receiver is exposed to the interior of the car. Especially, the railcar bodyshell is constituted by a plurality of members made of metal having high heat conductivity, and these members are coupled to one another by welding, bolts, rivets, and the like. Therefore, heat transfer paths are formed inside and outside the car by the seat receiver and the underframe, so that there is a problem that adequate heat insulating performance cannot be secured. Further, since the seat receiver is exposed to the interior of the car for the purpose of supporting the seats, large floor panels cannot be used. Therefore, the heat insulating property deteriorates, and the number of floor panels increases.

An object of the present invention is to provide a railcar including a carbody having an improved heat insulating property by a simple structure.

Solution to Problem

In order to solve the above problems, a railcar according to one aspect of the present invention includes a floor structure, the floor structure including: an underframe including a pair of side sills and a plurality of cross beams arranged between the pair of side sills; a plurality of floor panel receivers located above the cross beams, arranged with gaps in a car width direction, extending along the cross beams, and fixed to the cross beams; one or more seat receivers extending through the gaps in a car longitudinal direction and fixed to the cross beams; and floor panels covering substantially entire surfaces of upper portions of the floor panel receivers and an upper portion(s) of the one or more seat receivers from above and supported by the cross beams through the floor panel receivers and the one or more seat receivers.

According to the above configuration, without exposing the seat receiver to an interior of the car, the upper portion of the seat receiver having high heat conductivity is covered from above with the floor panel having a high heat insulating property, and the floor panel is supported by the cross beam through the floor panel receivers and the seat receiver. Therefore, heat transfer by a heat bridge formed between the underframe and the floor panel can be suppressed. To be specific, the transfer of the heat from a lower side of the carbody through the cross beam to the floor panel can be suppressed, and the flow of cold air from under a floor into the interior of the car can be suppressed. Further, since the upper portion of the seat receiver is covered with the floor panel from above, it is unnecessary to divide the floor panel for the purpose of exposing the seat receiver to the interior of the car. Therefore, an increase in the number of floor panels can be suppressed.

Advantageous Effects of Invention

The above aspect of the present invention can provide a railcar including a carbody having an improved heat insulating property by a simple structure.

DESCRIPTION OF EMBODIMENTS

Embodiment

Hereinafter, an embodiment of the present invention will be explained in reference to the drawings.

Railcar

Figure 1:
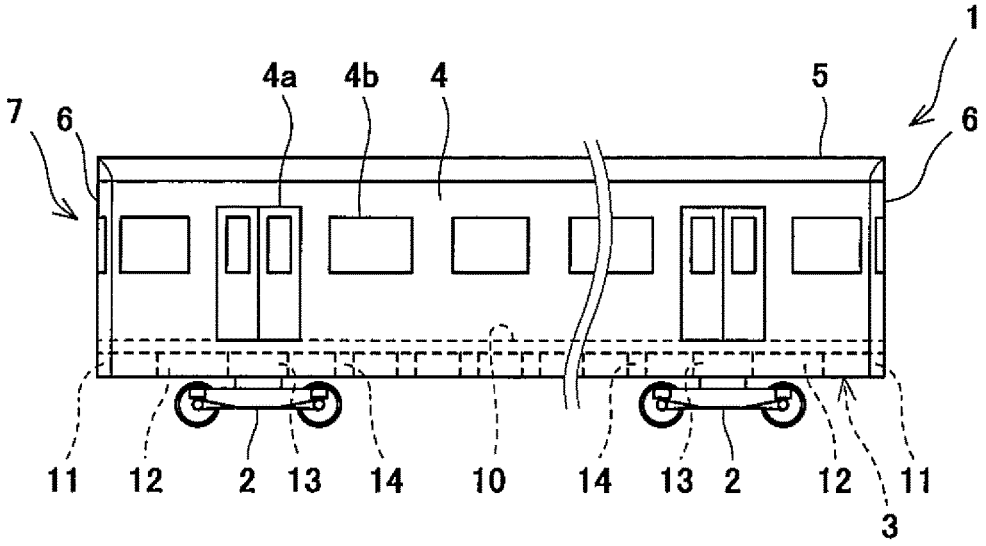
FIG. 1 is a schematic side view of a railcar according to an embodiment.

As shown in FIG. 1, a railcar 1 includes a pair of bogies 2 and a carbody (railcar bodyshell) 7 supported by the bogies 2. The carbody 7 includes an underframe (floor bodyshell) 3, side bodyshells 4, a roof bodyshell 5, and end bodyshells 6. The side bodyshells 4 are arranged at both respective car width direction sides of the underframe 3, and door openings 4a and window openings 4b are formed on the side bodyshells 4. The roof bodyshell 5 is arranged above the side bodyshells 4 and coupled to the side bodyshells 4. The end bodyshells 6 are arranged at both respective car longitudinal direction sides of the underframe 3.

The underframe 3 includes side sills 10, end beams 11, center sills 12, bolster beams 13, and cross beams 14. The side sills 10 are beams located at both respective car width direction sides of the underframe 3 and extending in a car longitudinal direction. The end beams 11 are beams extending in a car width direction, and each of the end beams 11 connects ends of the side sills 10 to each other. The bolster beams 13 are beams extending in the car width direction and are arranged at a car longitudinal direction inner side of the end beams 11 in the railcar 1. Each of the bolster beams 13 connects the pair of side sills 10 to each other. The bogies 2 are coupled to respective lower portions of the bolster beams 13. The center sills 12 are beams extending in the car longitudinal direction. Each of the center sills 12 is arranged between the end beam 11 and the bolster beam 13 and connects the end beam 11 and the bolster beam 13 to each other. The cross beams 14 are beams extending in the car width direction and are arranged between the pair of bolster beams 13. Each of the cross beams 14 connects the pair of side sills 10 to each other.

Figure 2:
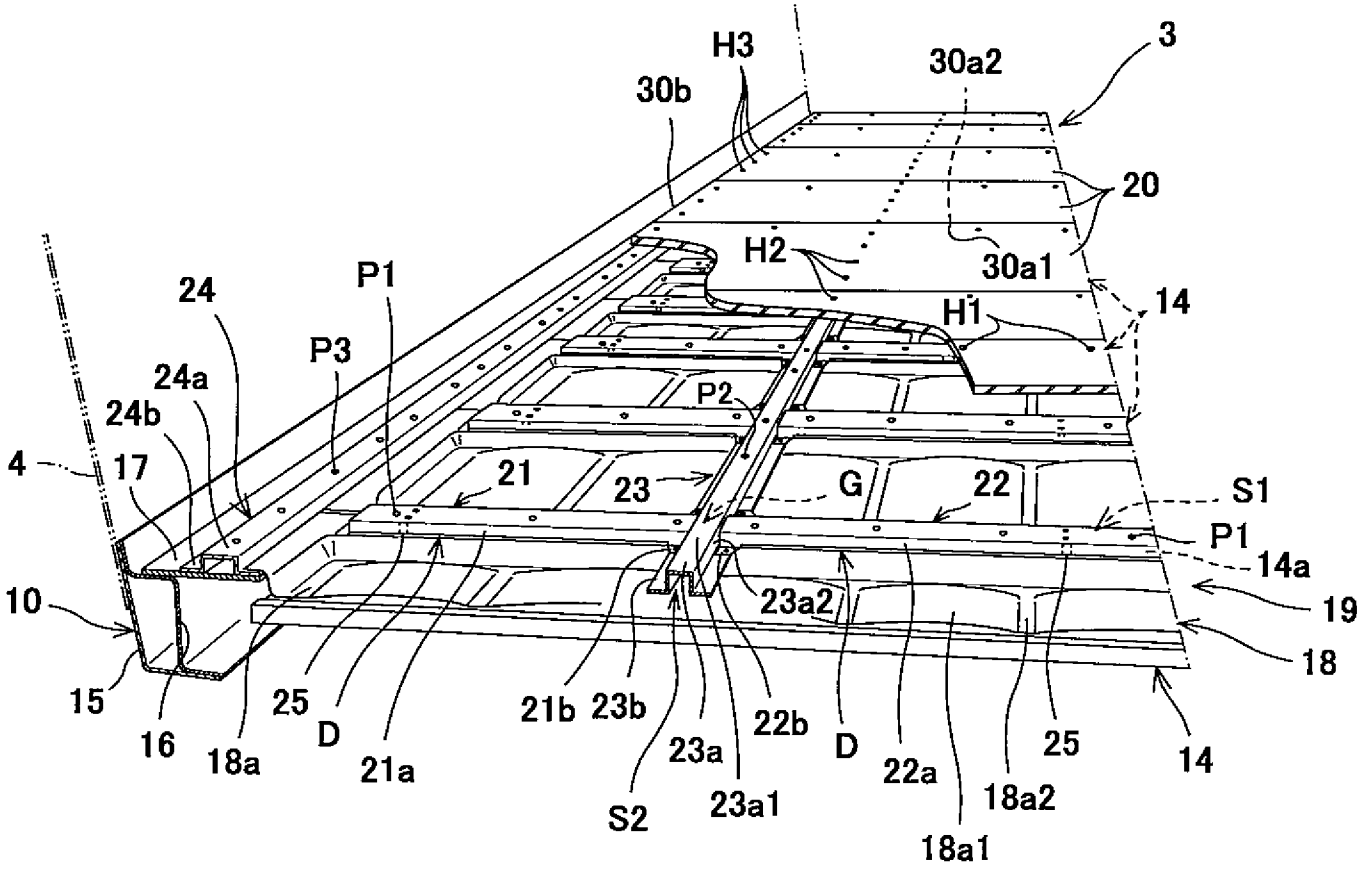
FIG. 2 is a partially perspective view showing an underframe, a floor panel supporting structure, and floor panels.

As shown in FIG. 2, each of the side sills 10 includes: a first plate member 15 having a substantially L-shaped cross section when viewed from the car longitudinal direction; a second plate member 16 combined with the first plate member 15 and having a substantially W-shaped cross section when viewed from the car longitudinal direction; and a third plate member 17 connected to the second plate member 16 and including an upper surface projecting in a horizontal direction, that is, projecting inward in the car width direction of the underframe 3. The first plate member 15, the second plate member 16, and the third plate member 17 extend in the car longitudinal direction. The second plate member 16 is combined with the first plate member 15 such that an internal space is formed between the first plate member 15 and the second plate member 16. Thus, a hollow structure is formed in the side sill 10.

Figure 4:
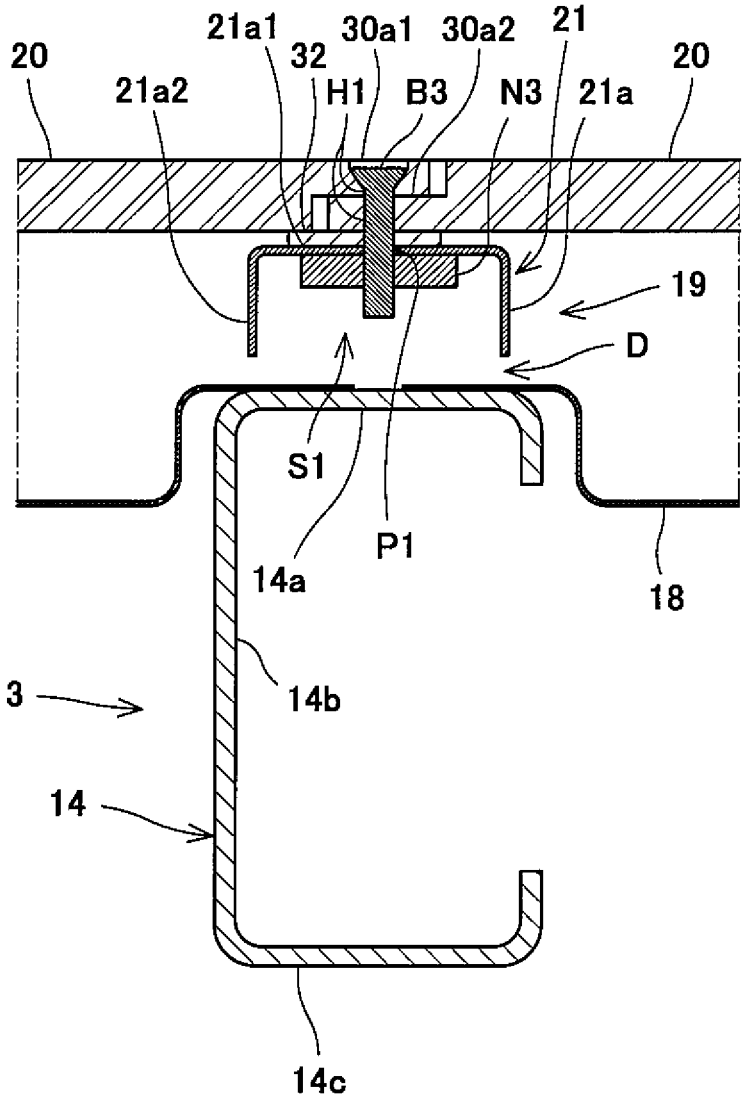
FIG. 4 is a cross sectional view taken along line IV-IV of FIG. 3.

The cross beams 14 extend in the car width direction, and both end portions of each of the cross beams are fixed to the respective side sills 10 by welding. As shown in FIG. 4, as one example, the cross beam 14 has a C-shaped cross section when viewed from the car width direction. The cross beam 14 includes: an upper plate portion 14*a* extending in the horizontal direction; a lower plate portion 14*c* extending in the horizontal direction and located under and spaced apart from the upper plate portion 14*a*; and a side plate portion 14*b* connected to one car longitudinal direction end of the upper plate portion 14*a* and one car longitudinal direction end of the lower plate portion 14*c*.

Figure 3:
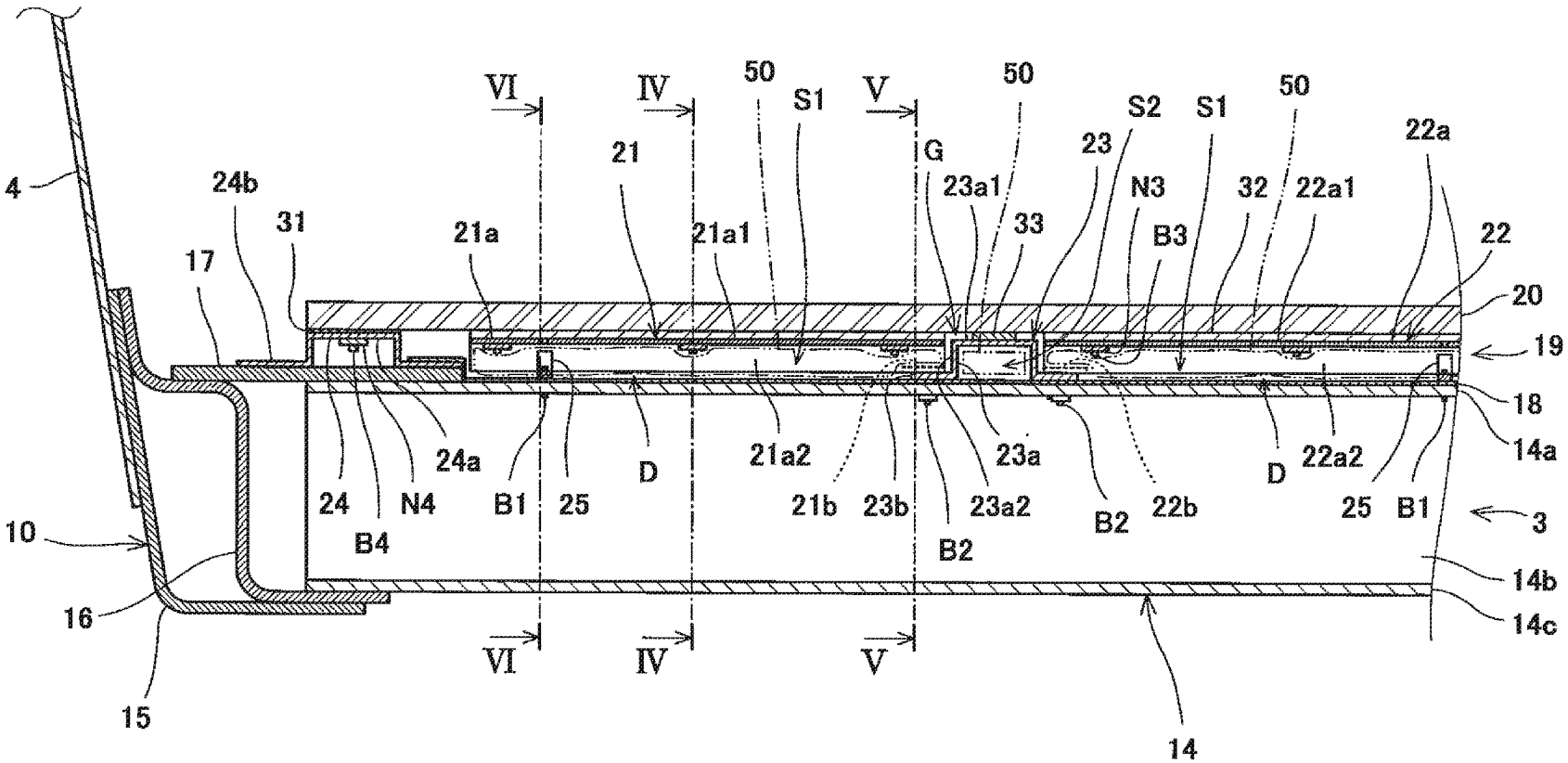
FIG. 3 is a partially cross sectional view showing the underframe, the floor panel supporting structure, and the floor panel when viewed from a car longitudinal direction.

As shown in FIGS. 2 and 3, floor pans 18 each having a bathtub shape are arranged in respective spaces each surrounded by the pair of side sills 10 and a pair of adjacent cross beams 14 among the cross beams 14. The floor pan 18 is fixed to the pair of side sills 10 and the pair of cross beams 14. The floor pan 18 bears a compressive load and shearing load applied from the pair of side sills 10 and the cross beams 14, and therefore, serves as a reinforcing member reinforcing the underframe 3. Therefore, as one example, a bottom wall portion 18*a* of the floor pan 18 includes: a plurality of mountain portions 18*a*1 extending in the car longitudinal direction and arranged at intervals in the car width direction; and a continuous flat portion 18*a*2 surrounding the plurality of mountain portions 18*a*1. The mountain portions 18*a* 1 swell upward in a vertical direction. A plurality of underfloor devices (such as a main transformer and a main converter), not shown, fixed to the carbody 7 are arranged under the floor pans 18. A floor panel supporting structure 19 is arranged above the underframe 3, and floor panels 20 are arranged above the floor panel supporting structure 19.

Floor Panel Supporting Structure

As shown in FIGS. 2 and 3, the floor panel supporting structure 19 supports the floor panels 20 from below in the carbody 7. The floor panel supporting structure 19 includes floor panel receivers 21 and 22, seat receivers 23, and side sill floor panel receivers 24 and is fixed to the underframe 3. In other words, the floor panels 20 cover substantially entire surfaces of upper portions of the floor panel receivers 21 and 22, the seat receivers 23, and the side sill floor panel receivers 24 from above. With this, heat transfer from a lower side of the carbody 7 is suppressed to a minimum.

Figure 7:
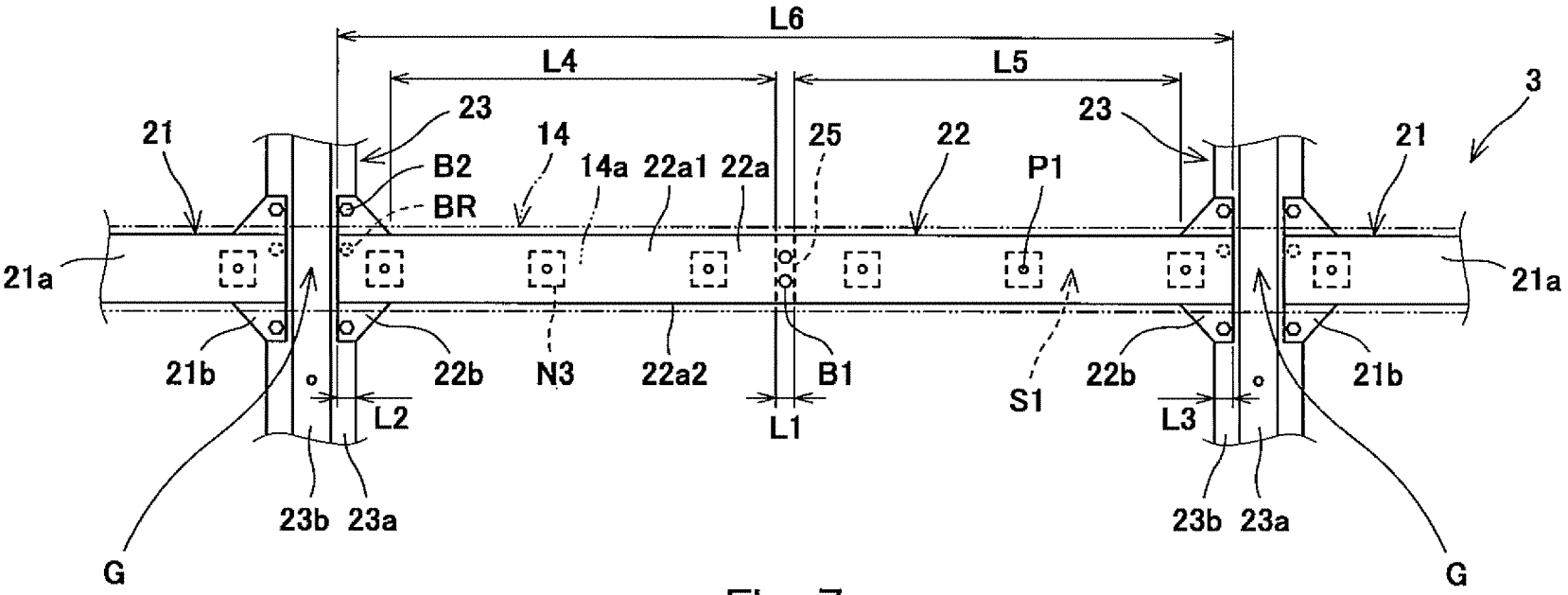
FIG. 7 is a plan view showing floor panel receivers when viewed from above.

The floor panel receivers 21 and 22 are supporting members extending in the car width direction and arranged at positions corresponding to the cross beams 14 and are fixed to the cross beams 14. As shown in FIG. 7, the floor panel receivers 21 and the floor panel receiver 22 are arranged in a row in the car width direction such that each of gaps G is formed between the floor panel receiver 21 and the floor panel receiver 22. To be specific, the floor panel receivers 21 are arranged at one car width direction end side and the other car width direction end side of the underframe 3, and the floor panel receiver 22 is arranged at a car width direction middle of the underframe 3. Then, the floor panel receivers 21 and 22 are arranged in a row in the car width direction such that each of the gaps G is formed between the floor panel receiver 21 and the floor panel receiver 22 (see FIG. 7). The floor panel receivers 21 and 22 are fixed to the upper plate portion 14*a* of the cross beam 14 through the floor pan 18. A car width direction position of the gap G located on one cross beam 14 coincides with a car width direction position of the gap G located on another cross beam 14 located adjacent to the above cross beam 14 in the car longitudinal direction. Each of the floor panel receivers 21 and 22 includes: a main body portion (21*a*, 22*a*; see FIG. 7) located above and spaced apart from the cross beam 14 and extending along the cross beam 14; and one or more fixed portions (flange portions (21*b*, 22*b*) and a leg portion 25) projecting downward from the main body portion (21*a*, 21*a*) and fixed to the cross beam 14.

Figure 6:
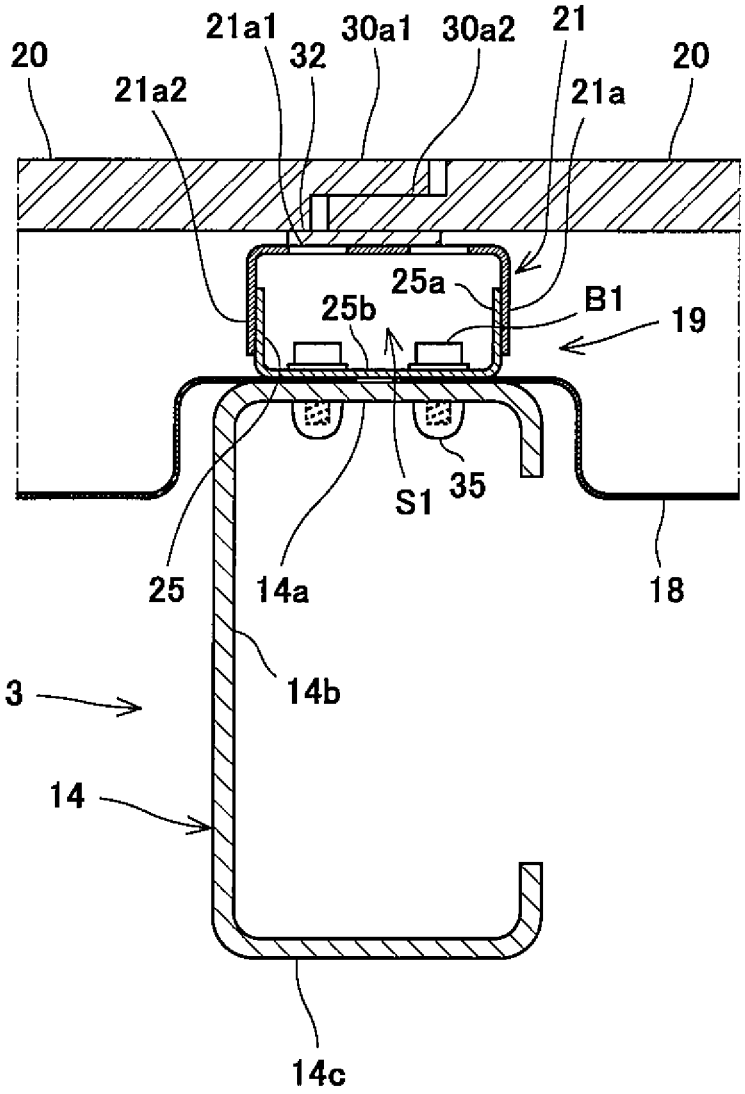
FIG. 6 is a cross sectional view taken along line VI-VI of FIG. 3.

Regarding the configurations of the floor panel receivers 21 and 22, the following will mainly and specifically explain the floor panel receiver 21. As shown in FIGS. 4 and 6, a cross sectional shape of the floor panel receiver 21 is basically a channel shape (U shape), the cross sectional shape being perpendicular to a longitudinal direction of the floor panel receiver 21. The leg portion 25 to be fixed to the cross beam 14 is partially provided at the floor panel receiver 21. As above, an area of contact of the floor panel receiver 21 with the cross beam 14 is smaller than that of a conventional structure.

The main body portion 21*a* of the floor panel receiver 21 has a groove-shaped cross section that is depressed upward when viewed from the car width direction. Specifically, the main body portion 21*a* includes an upper plate portion (upper portion of the main body portion 21*a*) 21*a*1 including an upper surface extending in the horizontal direction; and a pair of side plate portions 21*a*2 extending downward from both respective car longitudinal direction end portions of the upper plate portion 21*a*1, and a first space S1 is formed inside the main body portion 21*a*. The upper surface of the upper plate portion 21*a*1 is formed to be flat. A plurality of insertion holes P1 into which bolts B3 are inserted are formed at the upper plate portion 21*a*1. As one example, car width direction lengths of the main body portions 21*a* of a pair of floor panel receivers 21 are equal to each other, and a car width direction length of the main body portion 22*a* of the floor panel receiver 22 is longer than the car width direction length of the main body portion 21*a* of each floor panel receiver 21 (see FIGS. 2 and 7). A car longitudinal direction length of the upper plate portion 21*a*1 of the floor panel receiver 21 is longer than one third of a car longitudinal direction length of the upper plate portion 14*a* of the cross beam 14. As one example, the car longitudinal direction length of the upper plate portion 21*a*1 is set to a value that is not less than 70% and not more than 100% of the car longitudinal direction length of the upper plate portion 14*a*. It should be noted that the car longitudinal direction length of the upper plate portion 21*a*1 may be set to be longer than the car longitudinal direction length of the upper plate portion 14*a*.

The first space S1 is formed between the upper plate portion 21*a*1 of the floor panel receiver 21 and the upper plate portion (upper portion of the cross beam 14) 14*a* of the cross beam 14. A flat upper surface of the main body portion 21*a* of floor panel receiver 21 supports the floor panel 20 from below through a spacer 32. In a region located at an inner side of both car width direction ends of the main body portion 21*a*, lower ends of the side plate portions 21*a*2 are spaced apart from the cross beam 14. Specifically, each of the lower ends of the side plate portions 21*a*2 is located higher than and spaced apart from an upper surface of the upper plate portion 14*a* of the cross beam 14 with a gap D. As above, the floor panel receiver 21 is located above the cross beam 14 and supports the floor panel 20. In addition, the first space S1 is formed inside the floor panel receiver 21, and the floor panel receiver 21 is spaced apart from the cross beam 14 with the gap D. With this, the area of the contact of the floor panel receiver 21 with the cross beam 14 is reduced. Thus, the heat transfer between the cross beam 14 and the floor panel receiver 21 is suppressed. It should be noted that heat insulating performance can be further improved by filling the first space S1 with a heat insulating material such as glass fiber or ceramic fiber.

Figure 5:
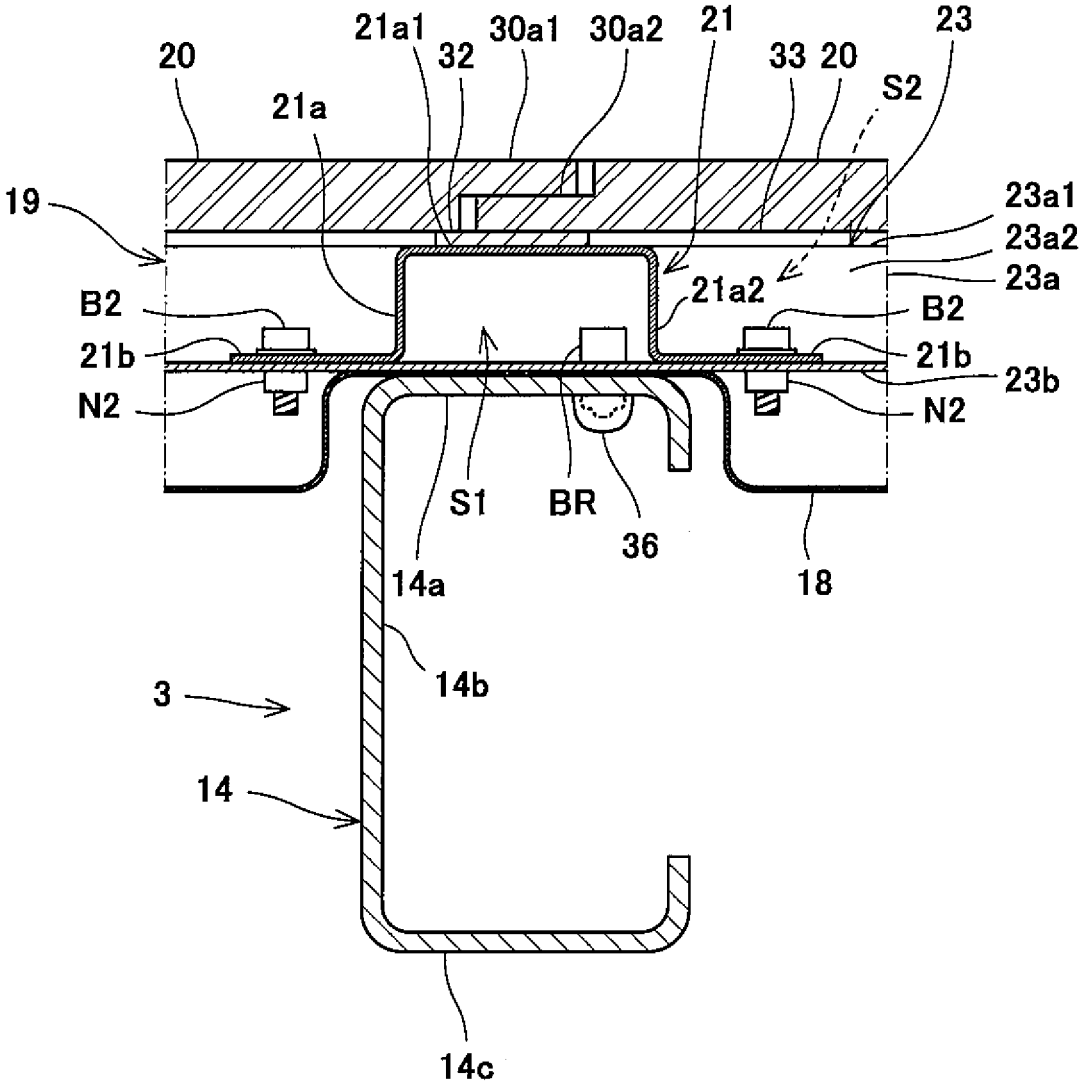
FIG. 5 is a cross sectional view taken along line V-V of FIG. 3.

As shown in FIGS. 2, 5, and 7, each of the floor panel receivers 21 and 22 is provided with the flange portions (21*b*, 22*b*) at portions overlapping the seat receiver 23 in plan view. Regarding each of the floor panel receivers 21 arranged at both respective car width direction sides, a pair of flange portions 21*b* are arranged at one car width direction end portion of the main body portion 21*a*, the one car width direction end portion being located at a car width direction inner side of the underframe 3, and a pair of flange portions 21*b* are not provided at the other car width direction end portion of the main body portion 21*a*. Regarding the floor panel receiver 22 provided at the car width direction middle, a pair of flange portions 22*b* are provided at each of both car width direction end portions of the main body portion 22*a*. To be specific, regarding each of the floor panel receivers 21 and 22, a pair of flange portions (21*b*, 22*b*) do not extend over the entire main body portion (21*a*, 22*a*) in the car width direction but are provided at a part of the main body portion (21*a*, 22*a*). The flange portions (21*b*, 22*b*) project from lower ends of the floor panel receiver (21, 22) in respective directions opposite to each other along the car longitudinal direction and fix the floor panel receiver (21, 22) to the cross beam 14. A cross sectional shape of a part, where the flange portions (21*b*, 22*b*) are provided, of the main body portion (21*a*, 22*a*) is a hat shape, the cross sectional shape being perpendicular to a longitudinal direction of the main body portion (21*a*, 22*a*). Specifically, by coupling the flange portions 21*b* and 22*b* to the seat receivers 23, the floor panel receivers 21 and 22 are fixed to the cross beam 14 through the seat receivers 23. Instead of coupling the flange portions 21*b* and 22*b* to the seat receivers 23, the flange portions 21*b* and 22*b* may be coupled to, for example, the upper plate portion 14*a* of the cross beam 14.

The car width direction length of the main body portion 22*a* of the floor panel receiver 22 is different from the car width direction length of the main body portion 21*a* of the floor panel receiver 21. The main body portion 22*a* of the floor panel receiver 22 includes an upper plate portion 22*a*1 and side plate portions 22*b*2. A cross sectional shape and size of the main body portion 22*a* of the floor panel receiver 22 when viewed from the car width direction are the same as those of the main body portion 21*a* of the floor panel receiver 21. Further, a shape and size of the flange portion 22*b* of the floor panel receiver 22 are the same as those of the flange portion 21*b* of the floor panel receiver 21.

As shown in FIG. 6, the leg portion 25 is provided at a part of the floor panel receiver (21, 22) so as to be located in a region that does not overlap the seat receiver 23 in plan view. The leg portion 25 projects downward from the main body portion 21*a* and is directly coupled to the cross beam 14 to fix the floor panel receiver 21 to the cross beam 14. Specifically, the leg portion 25 includes: a pair of side plate portions 25*a* connected to a pair of side plate portions 21*a*2 by welding and extending downward; and a connecting plate portion 25*b* connecting lower portions of the side plate portions 25*a* to each other in the horizontal direction. The leg portion 25 has a groove-shaped cross section that is depressed downward when viewed from the car width direction. When viewed from above, the connecting plate portion 25*b* is covered with the upper plate portion 21*a*1 of the main body portion 21*a*. A lower surface of the connecting plate portion 25*b* is formed to be flat. The lower surface of the connecting plate portion 25*b* opposes the upper surface of the upper plate portion 14*a* of the cross beam 14 through the floor pan 18. The leg portion 25 is fixed to the upper plate portion 14*a* by tightening bolts B1 in a state where the lower surface of the connecting plate portion 25*b* is stacked on the upper surface of the upper plate portion 14*a* through the floor pan 18. Thus, the floor panel receiver 21 is fixed to the cross beam 14. A part of the bolt B1 which part is exposed from a lower surface of the upper plate portion 14*a* is covered with a waterproof seal 35.

In each of the floor panel receivers 21 and 22, a sum of car width direction lengths of the fixed portions (i.e., a sum of a car width direction length of the flange portion (21*b*, 22*b*) and a car width direction length of the leg portion 25) is set to be shorter than a car width direction length of the main body portion (21*a*, 22*a*). The leg portion 25 is connected to a car width direction end portion of the main body portion 21*a* of the floor panel receiver 21 such that a car width direction position of the leg portion 25 is different from a car width direction position of the insertion hole P1, the car width direction end portion being opposite to a car width direction end portion where the flange portions 21*b* are provided (see FIG. 2). In the floor panel receiver 22, the leg portion 25 is connected to a car width direction middle of the main body portion 21*a* (see FIG. 7). As above, according to the floor panel receivers 21 and 22, since the sum of the car width direction lengths of the fixed portions (the flange portion (21*b*, 22*b*) and the leg portion 25) is set to be shorter than the car width direction length of the main body portion (21*a*, 22*a*), the heat transfer from the cross beam 14 through the fixed portions to the floor panel receivers 21 and 22 is suppressed.

A car longitudinal direction length of the connecting plate portion 25*b* of the leg portion 25 is longer than one third of a car longitudinal direction length of the upper plate portion 14*a* of the cross beam 14. As one example, the car longitudinal direction length of the connecting plate portion 25*b* is set to a value that is not less than 70% and not more than 100% of the car longitudinal direction length of the upper plate portion 14*a*. It should be noted that the car longitudinal direction length of the connecting plate portion 25*b* may be set to be longer than the car longitudinal direction length of the upper plate portion 14*a* as long as a pair of side plate portions 25*a* are connectable to a pair of side plate portions 21*a*2 of the main body portion 21*a*. A material of the leg portion 25 is the same as that of the main body portion 21*a* but may be different from that of the main body portion 21*a* (for example, may be a material having lower thermal conductivity than the main body portion 21*a*).

As above, each of the floor panel receivers 21 and 22 includes at least three sections having respective cross sections different from one another when viewed from the car width direction. To be specific, each of the floor panel receivers 21 and 22 includes: a first section (see FIG. 4) spaced apart from the cross beam 14; a second section (see FIG. 5) where a pair of flange portions (21*b*, 22*b*) are provided at the main body portion (21*a*, 22*a*); and a third section (see FIG. 6) where the leg portion 25 is connected to the main body portion (21*a*, 22*a*).

To appropriately suppress the heat transfer from the cross beam 14 through the fixed portions (the flange portions (21*b*, 22*b*) and the leg portion 25) to the floor panel receiver (21, 22), the floor panel receivers 21 and 22 are configured as below, for example. To be specific, in the floor panel receivers 21 and 22, when LA denotes a sum of car width direction lengths of fixed parts at each of which the flange portion (21*b*, 22*b*) provided at the main body portion (21*a*, 22*a*) and the seat receiver 23 are fixed to each other and car width direction lengths of the leg portions 25, and LB denotes a car width direction length of a part of the floor panel receiver (21, 22), the part being spaced apart from the cross beam 14, LA is set to be shorter than LB.

As shown in FIG. 7, for example, in the floor panel receiver 22, LA corresponds to a sum (L1+L2+L3) of: a sum of car width direction lengths (L2+L3) of fixed parts at each of which the flange portion 22*b* provided at one of both car longitudinal direction sides of the main body portion 22*a* and the seat receiver 23 are fixed to each other; and a car width direction length L1 of the leg portion 25. Further, LB corresponds to a sum (L4+LS) of a car width direction length L4 of the floor panel receiver 22 between the leg portion 25 and the flange portion 22*b* arranged at one car longitudinal direction side of the main body portion 22*a* and a car width direction length LS of the floor panel receiver 22 between the leg portion 25 and the flange portion 22*b* arranged at the other car longitudinal direction side of the main body portion 22*a*. In the floor panel receiver 22, LA (=L1+L2+L3) is set to be shorter than LB (=L4+LS). As one example, in the floor panel receivers 21 and 22, LA is set to be a value that is not less than 5% and not more than 20% of LB. Further, as one example, in the floor panel receivers 21 and 22, the car width direction length L1 of the leg portion 25 is set to be a value that is not less than 1% and not more than 5% of an entire car width direction length L6 of the floor panel receiver (21, 22).

As shown in FIG. 2, the seat receiver 23 supports the floor panel 20 together with the floor panel receivers 21 and 22 at a position above the cross beam 14 and supports seats (not shown) arranged inside the car. The seat receiver 23 is provided above a plurality of cross beams 14, extends in the car longitudinal direction through the gap G between the floor panel receivers 21 and 22 lined up in the car width direction, and is fixed to the plurality of cross beams 14. Specifically, one or more seat receivers 23 extend linearly in the car longitudinal direction and are fixed to the upper plate portions 14*a* of two or more adjacent cross beams 14. In the railcar 1, a pair of seat receivers 23 are located above the cross beams 14 and extend in the car longitudinal direction through two respective gaps G lined up in the car width direction. To be specific, the seat receiver 23 is not divided by the floor panel receivers 21 and 22.

The seat receiver 23 is constituted by a base portion 23*a* and a pair of flange portions 23*b*, and a cross sectional shape of the seat receiver 23 is a hat shape, the cross sectional shape being perpendicular to a longitudinal direction of the seat receiver 23. The seat receiver 23 extends in the car longitudinal direction perpendicular to the cross beam 14. Therefore, since the seat receiver 23 just contacts the cross beam 14 by the flange portions 23*b* intersecting with the cross beam 14, the heat transfer path can be suppressed to a minimum. The seat receiver 23 includes the base portion 23*a* and the pair of flange portions 23*b* projecting from lower portions of the base portion 23*a* in respective directions opposite to each other, and a second space S2 is formed in the seat receiver 23. The base portion 23*a* includes: an upper plate portion (upper portion of the base portion 23*a*) 23*a*1 extending in the horizontal direction; and a pair of side plate portion 23*a*2 extending downward from both respective car width direction end portions of the upper plate portion 23*a*1. The base portion 23*a* has a groove-shaped cross section that is depressed upward when viewed from the car longitudinal direction. An upper surface of the upper plate portion 23*a*1 is flat, and a plurality of insertion holes P2 through which bolts (not shown) are inserted are formed on the upper surface of the upper plate portion 23*a*1 so as to be lined up in the car longitudinal direction. The second space S2 is formed between the upper plate portion 23*a*1 of the base portion 23*a* and the upper plate portion 14*a* of the cross beam 14. A height of an upper surface of the base portion 23*a* is substantially equal to heights of upper surfaces of the main body portions 21*a* and 22*a* of the floor panel receivers 21 and 22.

As shown in FIG. 5, the flat upper surface of the base portion 23*a* of the seat receiver 23 supports the floor panel 20 from below through a spacer 33. The flange portion 23*b* is coupled to the flange portions 21*b* by tightening bolts B2 and nuts N2 in a state where the flange portion 23*b* and the flange portions 21*b* of the floor panel receiver 21 are stacked on each other. Although not shown, the flange portion 23*b* is coupled to the flange portions 22*b* by tightening the bolts B2 and the nuts N2 in a state where the flange portion 23*b* and the flange portions 22*b* of the floor panel receiver 22 are stacked on each other. The pair of flange portions 23*b* are stacked on the upper plate portion 14*a* of the cross beam 14 through the floor pan 18 and then fixed to the cross beam 14 by a blind rivet BR. With this, the seat receiver 23 is fixed to the cross beam 14, and one end portion of the floor panel receiver 21 and one end portion of the floor panel receiver 22 are fixed to the cross beam 14 through the seat receiver 23. As above, the seat receiver 23 supports the floor panel 20 at a position above the cross beam 14, and the second space S2 is formed inside the seat receiver 23. Further, the seat receiver 23 is fixed such that the longitudinal direction of the seat receiver 23 intersects with the cross beam 14, so that the area of the contact of the seat receiver 23 with the cross beam 14 is reduced. Thus, the heat transfer between the cross beam 14 and the seat receiver 23 is suppressed. A part of the blind rivet BR which part is exposed from the lower surface of the upper plate portion 14*a* is covered with a waterproof seal 36. It should be noted that a cross sectional shape of the seat receiver 23 may be a channel shape, the cross sectional shape being perpendicular to the longitudinal direction of the seat receiver 23.

As shown in FIG. 2, the side sill floor panel receivers 24 support both respective car width direction ends of the floor panel 20 at positions above the side sills 10. Each of the side sill floor panel receivers 24 extends in the car longitudinal direction, is arranged above the third plate member 17, and is fixed to the upper surface of the third plate member 17. A cross sectional shape of the side sill floor panel receiver 24 is a hat shape, the cross sectional shape being perpendicular to a longitudinal direction of the side sill floor panel receiver 24. The side sill floor panel receiver 24 includes: a main body portion 24*a* having a groove-shaped cross section that is depressed upward when viewed from the car longitudinal direction; and a pair of flange portions 24*b* projecting from lower portions of the main body portion 24*a* in respective directions opposite to each other. An upper surface of the main body portion 24*a* is flat, and a plurality of insertion holes P3 through which bolts B4 (see FIG. 3) are inserted are formed on the upper surface of the main body portion 24*a* so as to be lined up in the car longitudinal direction. A height of the upper surface of the main body portion 24*a* is substantially equal to heights of upper portions of the base portion 23*a* of the seat receiver 23 and the main body portions 21*a* and 22*a* of the floor panel receivers 21 and 22. A pair of flange portions 24*b* are stacked on the upper surface of the third plate member 17 and then fixed to the third plate member 17 by welding. With this, the side sill floor panel receiver 24 reinforces the third plate member 17 and prevents buckling. Further, the flat upper surface of the main body portion 24*a* of the side sill floor panel receiver 24 supports the floor panel 20 from below through a spacer 31 (see FIG. 3). It should be noted that as with the seat receiver 23, a cross sectional shape of the side sill floor panel receiver 24 may be a channel shape, the cross sectional shape being perpendicular to the longitudinal direction of the side sill floor panel receiver 24.

For example, the floor panel 20 is constituted by: a panel formed such that an entire surface of plywood, balsawood, foamed resin material, or the like is covered with a thin plate made of metal such as SUS or a fiber-reinforced resin material; or a honeycomb panel. Therefore, the floor panel 20 has adequate rigidity and incombustibility and also has a high heat insulating property. The floor panel 20 configured as above has a rectangular contour shape extending in the car width direction in plan view. A plurality of floor panels 20 are arranged above the floor panel supporting structure 19 so as to be lined up in the car longitudinal direction and are fixed to the floor panel receivers 21 and 22 and the side sill floor panel receivers 24. The floor panel 20 is arranged at a position that overlaps a plurality of cross beams 14 and a pair of side sills 10 when viewed from the vertical direction. The floor panel 20 includes: insertion holes H1 formed at positions corresponding to the insertion holes P1 of the floor panel receivers 21 and 22; insertion holes H2 formed at positions corresponding to the insertion holes P2 of the seat receivers 23; and insertion holes H3 formed at positions corresponding to the insertion holes P3 of the side sill floor panel receivers 24.

As shown in FIG. 4, each of a thickness of a first end portion 30*a*1 of the floor panel 20 which portion is located at one car longitudinal direction end of the floor panel 20 and a thickness of a second end portion 30*a*2 of the floor panel 20 which portion is located at the other car longitudinal direction end of the floor panel 20 is formed to be half a thickness of a portion of the floor panel 20 other than the first end portion 30*a*1 and the second end portion 30*a*2. A height of an upper surface of the first end portion 30*a*1 is equal to a height of an upper surface of a portion of the floor panel 20 other than the second end portion 30*a*2, and a height of a lower surface of the second end portion 30*a*2 is equal to a height of a lower surface of a portion of the floor panel 20 other than the first end portion 30*a*1. The first end portion 30*a*1 of one of a pair of floor panels 20 arranged adjacent to each other in the car longitudinal direction is stacked on the second end portion 30*a*2 of the other floor panel 20. With this, the heights of the upper surfaces of the adjacent floor panels 20 become equal to each other. Then, the pair of floor panels 20 are fixed to the floor panel receiver 21 by tightening bolts B3 and screw seats N3 through the insertion holes H1 and P1 of the floor panels 20 and the floor panel receivers 21 in a state where the first end portion 30*a*1 and the second end portion 30*a*2 are stacked on each other, and the second end portion 30*a*2 is stacked on the upper surfaces of the main body portions 21*a* of the floor panel receivers 21 through the spacers 32. Although not shown, the pair of floor panels 20 are fixed to the floor panel receiver 22 in the same manner as above.

As shown in FIG. 3, the floor panel 20 is fixed to the side sill floor panel receiver 24 by tightening bolts B4 and screw seats N4 through the insertion holes H3 and P3 (see FIG. 2) of the floor panel 20 and the side sill floor panel receiver 24 in a state where the floor panel 20 is stacked on the main body portion 24*a* of the side sill floor panel receiver 24 through the spacer 31. As above, in a state where the floor panel 20 covers from above the upper plate portions 21*a*1 and 22*a*2 of the floor panel receivers 21 and 22 and the upper plate portion 23*a*1 of the base portion 23*a* of the seat receiver 23, the floor panel 20 is fixed to the cross beams 14 through the floor panel receivers 21 and 22 and also fixed to the side sills 10 through the side sill floor panel receivers 24. Further, the seats are fixed to the seat receivers 23 by tightening bolts and screw seats (both not shown) through the insertion holes H2 and P2 (see FIG. 2) of the floor panels 20 and the seat receivers 23 in a state where the seats are stacked on the seat receivers 23 through the floor panels 20 and the spacers 33.

A heat insulating material for heat insulation between the underframe 3 and the floor panel 20 is provided at a predetermined place between the underframe 3 and the floor panel 20. Heat insulating materials 50 are arranged in the first spaces Si and the second spaces S2. Further, heat insulating materials (not shown) are arranged between the underframe 3 and the floor panel 20, and specifically, around the floor panel receivers 21 and 22, the seat receivers 23, and the side sill floor panel receivers 24, in the gaps G, between the main body portion 24*a* of the side sill floor panel receiver 24 and the third plate member 17, and between the floor pan 18 and the floor panel 20. Heat insulating materials are not arranged in any of the side sills 10 and the cross beams 14.

As explained above, according to the railcar 1, without exposing the seat receiver 23 to an interior of the car, the base portion 23*a* of the seat receiver 23 having high heat conductivity is covered from above with the floor panel 20 having a high heat insulating property, and the floor panel 20 is supported by the cross beam 14 through the floor panel receivers 21 and 22 and the seat receiver 23. Therefore, the heat transfer by a heat bridge formed between the underframe 3 and the floor panel 20 can be suppressed. To be specific, the transfer of the heat from a lower side of the carbody through the cross beam 14 to the floor panel 20 can be suppressed, and the flow of cold air from the lower side of the carbody into the interior of the car can be suppressed. Further, since the side sills 10 and the cross beams 14 are spaced apart from the floor panels 20, it is unnecessary to insert heat insulating materials into the side sills 10 and the cross beams 14. Furthermore, since the upper plate portions 23*a*1 of the seat receivers 23 are covered with the floor panels 20 from above, it is unnecessary to divide the floor panels 20 for the purpose of exposing the seat receivers 23 to the interior of the car. Therefore, the increase in the number of floor panels 20 can be suppressed. On this account, the heat insulating property of the carbody of the railcar 1 can be improved by a simple structure.

Further, since each of the first spaces S1 is formed between the upper plate portion (21*a*1, 22*a*1) of the floor panel receiver (21, 22) and the upper plate portion 14*a* of the cross beam 14, and each of the second spaces S2 is formed between the upper plate portion 23*a*1 of the seat receiver 23 and the upper plate portion 14*a* of the cross beam 14, the transfer of the heat from the lower side of the carbody through the cross beams 14 to the floor panel receivers 21 and 22 and the seat receivers 23 can be further suppressed. As above, according to the floor panel receivers 21 and 22 and the seat receiver 23, the fixed parts fixed to the cross beams 14 to support the floor panels 20 are minimized, and the area of the contact with the cross beams 14 is significantly reduced. With this, the heat transfer between the lower side of the carbody and the interior of the car can be significantly suppressed.

The main body portions 21*a* and 22*a* of the floor panel receivers 21 and 22 are located above and spaced apart from the cross beam 14 and extend along the cross beam 14, and a sum of the car width direction lengths of the fixed portions, fixed to the cross beam 14, of the floor panel receivers 21 and 22 (i.e., a sum of the car width direction lengths of the flange portions 21*b* and 22*b* and the car width direction length of the leg portion 25) is set to be shorter than a sum of the lengths of the main body portions 21*a* and 22*a*. Therefore, the heat from the lower side of the carbody is hardly transferred through the cross beams 14 to the floor panel receivers 21 and 22. Further, since each of the main body portions 21*a* and 22*a* of the floor panel receivers 21 and 22 is spaced apart from the cross beam 14 by the gap D, the transfer of the heat from the lower side of the carbody through the cross beams 14 and the floor panel receivers 21 and 22 to the floor panels 20 can be further appropriately suppressed. Further, since each of the main body portions 21*a* and 22*a* has a groove-shaped cross section that is depressed upward when viewed from the car width direction, the floor panel receivers 21 and 22 have high structural strength. Therefore, the floor panel receivers 21 and 22 hardly deform even by, for example, a compressive force applied from above, and the flat upper surfaces of the upper plate portions 21*a*1 and 22*a*1 of the floor panel receivers 21 and 22 can stably support the floor panels 20 from below.

Further, a plurality of floor panel receivers 21 and 22 and one or more seat receivers 23 can be strongly coupled to one another by coupling the flange portions 21*b* and 22*b* of the floor panel receivers 21 and 22 to the flange portions 23*b* of the seat receivers 23. Therefore, the floor panel supporting structure 19 having high structural strength can be configured.

Further, since the base portion 23*a* of the seat receiver 23 has the groove-shaped cross section that is depressed upward when viewed from the car longitudinal direction, the seat receiver 23 has high structural strength as with the main body portions 21*a* and 22*a* of the floor panel receivers 21 and 22. Therefore, the seat receiver 23 hardly deforms even by, for example, the compressive force applied from above, and the flat upper surface of the upper plate portion 23*a*1 of the base portion 23*a* can stably support the floor panel 20 from below. Further, since the second space S2 is formed inside the base portion 23*a*, the transfer of the heat from the lower side of the carbody through the cross beam 14 and the seat receiver 23 to the floor panel 20 can be suppressed. Furthermore, the seat receiver 23 can be strongly fixed to the cross beam 14 by fixing a pair of flange portions 23*b*, projecting from the lower portions of the base portion 23*a* in respective directions opposite to each other, to the cross beam 14.

Further, the heat insulating materials can be arranged between the underframe 3 and the floor panel 20, and specifically, in the gaps G, the first spaces S1, and the second spaces S2. Therefore, without arranging the heat insulating materials in the side sills 10 and the cross beams 14, the transfer of the heat from the lower side of the carbody through the cross beams 14 to the floor panels 20 can be appropriately suppressed.

Further, since the floor panels 20 are supported by the pair of side sills 10 through the side sill floor panel receivers 24, the floor panels 20 can be stably supported by the floor panel receivers 21 and 22, the seat receivers 23, and the side sill floor panel receivers 24 from below. Furthermore, by supporting the floor panels 20 by the side sill floor panel receivers 24, the contact of the floor panels 20 with the pair of side sills 10 is avoided. Therefore, the transfer of the heat from the lower side of the carbody through the pair of side sills 10 to the floor panels 20 can be suppressed. Thus, the decrease in the heat insulating property of the carbody can be appropriately prevented.

Modified Example

Figure 8:
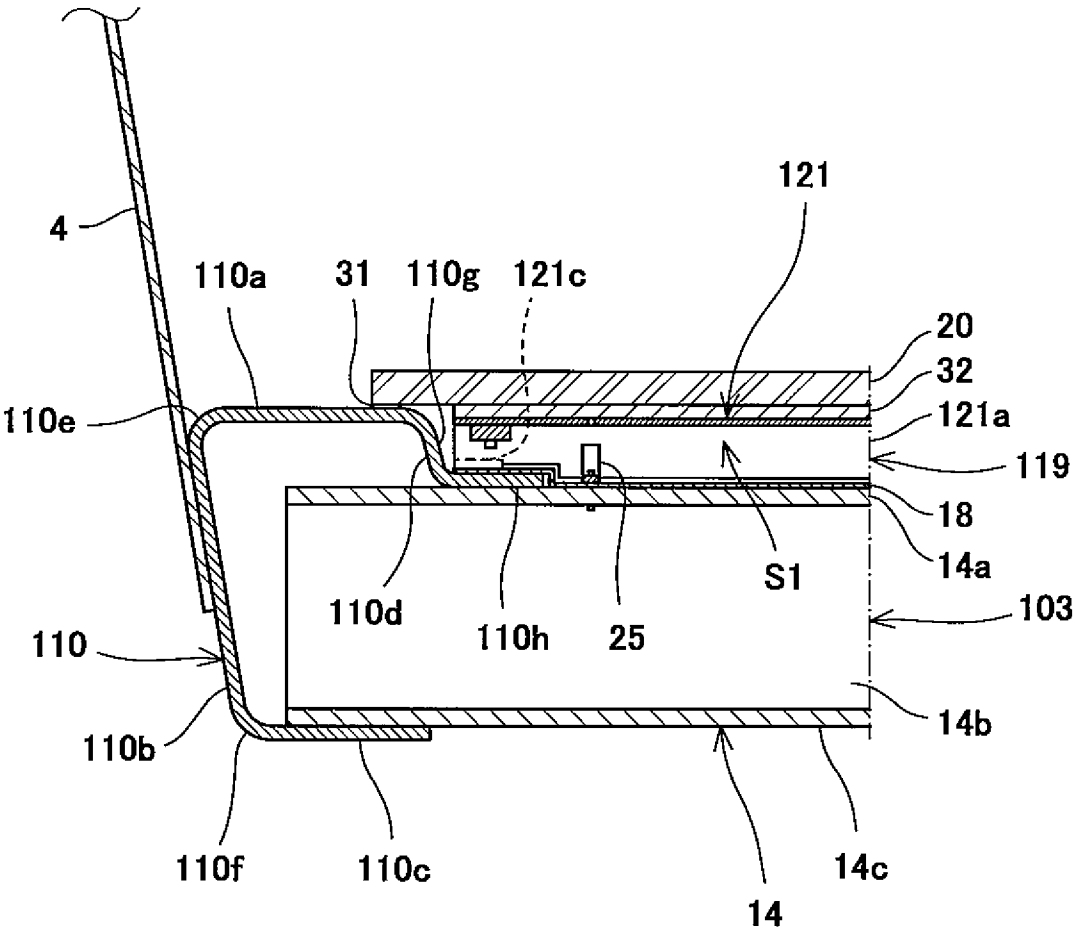
FIG. 8 is a partially cross sectional view showing the underframe, the floor panel supporting structure, and the floor panel according to a modified example of the embodiment when viewed from the car longitudinal direction.

Hereinafter, the following will mainly explain differences between the embodiment and a modified example of the embodiment. FIG. 8 is a partially cross sectional view showing an underframe 103, a floor panel supporting structure 119, and the floor panel 20 according to the modified example of the embodiment when viewed from the car longitudinal direction.

As shown in FIG. 8, a side sill 110 of the underframe 103 includes an upper plate portion 110*a*, a side plate portion 110*b*, a lower plate portion 110*c*, and a connecting plate portion 110*d*. The upper plate portion 110*a* is located higher than the upper plate portion 14*a* of one car width direction end portion of the cross beam 14 and extends in the horizontal direction. The lower plate portion 110*c* is located lower than a lower portion (lower plate portion 14*c*) of one car width direction end portion of the cross beam 14, extends in the horizontal direction, and is fixed to the lower plate portion 14*c*. A lower surface of the lower plate portion 14*c* is stacked on an upper surface of the lower plate portion 110*c*. The side plate portion 110*b* is located at a car width direction outer side of one car width direction end portion of the cross beam 14, extends in an upward/downward direction, is connected to the side bodyshell 4, and connects the upper plate portion 110*a* and the lower plate portion 110*c* to each other. Specifically, the side plate portion 110*b* connects an end portion 110*e* of the upper plate portion 110*a* and an end portion 110*f* of the lower plate portion 110*c* to each other, the end portions 110*e* and 110*f* being located at a car width direction outer side. The connecting plate portion 110*d* includes a first plate portion 110*g* and a second plate portion 110*h* and connects the upper plate portion 110*a* and the upper plate portion 14*a* of one car width direction end portion of the cross beam 14 to each other. The first plate portion 110*g* extends from a car width direction inner end portion of the upper plate portion 110*a* downward toward the upper plate portion 14*a* of the cross beam 14. The second plate portion 110*h* extends from a lower end portion of the first plate portion 110*g* along the cross beam 14 inward in the car width direction and is connected to the upper plate portion 14*a* of the cross beam 14. A lower surface of the second plate portion 110*h* is stacked on the upper surface of the upper plate portion 14*a*. The upper plate portion 110*a* of the side sill 110 supports the floor panel 20 from below through the spacer 31.

A pair of flange portions 121*c* are provided at a car width direction end portion of a main body portion 121*a*, located at a car width direction outer side, of a floor panel receiver 121 arranged at one car width direction end side of the underframe 103. The pair of flange portions 121*c* are coupled to the second plate portion 110*h* by tightening bolts and nuts or screw seats (both not shown) in a state where the flange portions 121*c* are stacked on an upper surface of the second plate portion 110*h* through the floor pans 18. With this, the car width direction end portion of the floor panel receiver 121 located at the car width direction outer side is fixed to the upper surface of the second plate portion 110*h*. A lower portion of the main body portion 121*a* located above the second plate portion 110*h* is partially and upwardly cut out for the purpose of avoiding interference between the main body portion 121*a* and the second plate portion 110*h*.

Thus, by fixing the floor panel receiver 121 to the cross beam 14 and the side sill 110, fixing strength between the underframe 103 and the floor panel supporting structure 119 can be increased. Further, by adjusting a height of the first plate portion 110*g* of the connecting plate portion 110*d* in accordance with a height of an upper surface of the upper plate portion 14*a* of the cross beam 14, for example, the height of the cross beam 14 can be reduced while maintaining the height of an upper surface of the upper plate portion 110*a*, and the upper plate portion 14*a* and the lower plate portion 14*c* can be fixed to the side sill 110. Thus, while maintaining the height of the upper surface of the floor panel 20 and appropriately preventing by the floor panel supporting structure 119 the deterioration of the heat insulating property of the carbody with respect to the heat from the lower side of the carbody, the weight of the cross beam 14 can be reduced. Further, for example, by reducing the height of the side plate portion 110*b* and the height of the cross beam 14, the height of the upper surface of the floor panel 20 can be lowered, and an inner space of the railcar can be widely secured.

Others

The present invention is not limited to the above embodiment and the above modified example, and modifications, addition, and eliminations of the components thereof may be made within the scope of the present invention. The above embodiment and the above modified example may be combined arbitrarily. For example, a part of the components or methods in the above embodiment may be applied to the above modified example.

In the above embodiment, the floor panel receivers 21 and 22, the seat receivers 23, and the side sill floor panel receivers 24 may directly support the floor panels 20 without through the spacers 31 to 33. Further, in the above embodiment, the heat insulating materials do not necessarily have to be provided between the underframe 3 and the floor panel 20, and specifically, around the floor panel receivers 21 and 22, the seat receivers 23, and the side sill floor panel receivers 24, in the gaps G, the first spaces S1, and the second spaces S2, between the main body portion 24*a* of the side sill floor panel receiver 24 and the third plate member 17, and between the floor pan 18 and the floor panel 20, and air layers may be provided. The heat insulating materials may be arranged in the side sills 10 and the cross beams 14.

In the above embodiment, the floor panels 20 cover the entire surfaces of the floor panel receivers 21 and 22, the seat receivers 23, and the side sill floor panel receivers 24 from above but do not necessarily have to completely cover all of these. The floor panels 20 may cover the floor panel receivers 21 and 22, the seat receivers 23, and the side sill floor panel receivers 24 to such a degree that substantially the same performance as above can be obtained or desired heat insulating performance can be obtained.

REFERENCE SIGNS LIST

G gap
S1 first space
S2 second space
1 railcar
3, 103 underframe
10, 110 side sill
14 cross beam
20 floor panel
21, 22, 121 floor panel receiver
21*a*, 22*a* main body portion
21*b*, 22*b* flange portion (fixed portion)
23 seat receiver
23*a* base portion
23*b* flange portion
24 side sill floor panel receiver
25 leg portion (fixed portion)
110*a* upper plate portion
110*b* side plate portion
110*c* lower plate portion
110*d* connecting plate portion
110*g* first plate portion
110*h* second plate portion

The invention claimed is:

1. A railcar comprising a floor structure, the floor structure including:

an underframe including a pair of side sills and a plurality of cross beams arranged between the pair of side sills;

a plurality of floor panel receivers located above the cross beams, arranged with gaps in a car width direction, extending along the cross beams, and fixed to the cross beams;

one or more seat receivers extending through the gaps in a car longitudinal direction and fixed to the cross beams; and floor panels covering substantially entire surfaces of upper portions of the floor panel receivers and an upper portion(s) of the one or more seat receivers from above and supported by the cross beams through the floor panel receivers and the one or more seat receivers.

2. The railcar according to claim 1, wherein:

each of first spaces is formed between the upper portion of the floor panel receiver and an upper portion of the cross beam; and each of second spaces is formed between the upper portion of the seat receiver and the upper portion of the cross beam.

3. The railcar according to claim 2, wherein:

each of main body portions of the floor panel receivers has a groove-shaped cross section that is depressed upward when viewed from the car width direction;

the first spaces are formed in the respective main body portions; and upper portions of the main body portions of the floor panel receivers support the floor panels from below.

4. The railcar according to claim 2, wherein:

the one or more seat receivers each includes a base portion having a groove-shaped cross section that is depressed upward when viewed from the car longitudinal direction;

the second space(s) is formed inside the base portion(s) of the one or more seat receivers; and an upper portion(s) of the base portion(s) of the one or more seat receivers supports the floor panels from below.

5. The railcar according to claim 1, wherein:

the floor structure further includes side sill floor panel receiver portions located above the respective side sills and extending in the car longitudinal direction;

heights of upper portions of the side sill floor panel receiver portions, heights of the upper portions of the floor panel receivers, and a height(s) of the upper portion(s) of the one or more seat receivers are substantially equal to one another; and the floor panels cover substantially entire surfaces of the upper portions of the side sill floor panel receiver portions, the upper portions of the floor panel receivers, and the upper portion(s) of the one or more seat receivers from above.

6. The railcar according to claim 5, wherein each of a cross sectional shape(s) of the one or more seat receivers, cross sectional shapes of the floor panel receivers, and cross sectional shapes of the side sill floor panel receiver portions is a channel shape or a hat shape, the cross sectional shapes being perpendicular to their longitudinal directions.

7. The railcar according to claim 5, wherein:

each of the side sill floor panel receiver portions includes an upper plate portion located higher than an upper portion of one car width direction end portion of the cross beam and extending in a horizontal direction, a lower plate portion located lower than a lower portion of the one car width direction end portion of the cross beam, extending in the horizontal direction, and fixed to the lower portion of the one car width direction end portion of the cross beam, a side plate portion located at a car width direction outer side of the one car width direction end portion of the cross beam, extending in an upward/downward direction, and connecting the upper plate portion and the lower plate portion to each other, and a connecting plate portion connecting the upper plate portion and an upper portion of the one car width direction end portion of the cross beam to each other;

the connecting plate portion includes a first plate portion extending from a car width direction inner end portion of the upper plate portion downward toward an upper portion of the cross beam and a second plate portion extending from a lower end portion of the first plate portion along the cross beam inward in the car width direction and connected to the upper portion of the cross beam; and car width direction outer end portions of the floor panel receivers are fixed to an upper surface of the second plate portion.

8. The railcar according to claim 1, wherein the floor structure further includes floor pans each arranged in a space surrounded by the pair of side sills and a pair of adjacent cross beams among the plurality of cross beams, the floor pans being fixed to the underframe.

9. The railcar according to claim 1, wherein:

each of the floor panel receivers includes a main body portion located above and spaced apart from the cross beam and extending along the cross beam and one or more fixed portions projecting downward from the main body portion and fixed to the cross beam; and a length(s) of the one or more fixed portions is shorter in the car width direction than a length of the main body portion.

* * * * *